United States Patent [19]

Delacour et al.

[11] Patent Number: 4,718,772

[45] Date of Patent: Jan. 12, 1988

[54] PROCESS AND APPARATUS FOR OBTAINING A MIXTURE OF SUBSTANCES HAVING LOW BOILING POINTS

[75] Inventors: Pierre Delacour, Noyaret; Roger Prost, Saint-Egreve, both of France

[73] Assignee: L'Air Liquide, Societe Anonyme pour l'Etude et l'Exploitation des Procedes Georges Claude, Paris, France

[21] Appl. No.: 792,695

[22] Filed: Oct. 15, 1985

[30] Foreign Application Priority Data

Oct. 19, 1984 [FR] France ..... 84 16015

[51] Int. Cl.[4] ..... B01F 3/00; B01F 13/00

[52] U.S. Cl. ..... 366/348; 366/144

[58] Field of Search ..... 366/341, 348, 144, 147, 366/131, 132, 134, 152, 154, 160, 189, 190, 177, 182; 261/19, 21, 23, 27, 39 R, 130; 62/21, 23

[56] References Cited

U.S. PATENT DOCUMENTS 1,757,022 5/1930 Simonis .
2,514,463 7/1950 Bayers, Jr. .

FOREIGN PATENT DOCUMENTS 2645219 4/1978 Fed. Rep. of Germany .
2133330 11/1972 France .

OTHER PUBLICATIONS

"Gaz d'aujourd'hui", vol. 79, No. 5, Realisation des melanges de gaz, May 1973, M. Rene Fort, pp. 229–242.

*Primary Examiner*—Timothy F. Simone
*Attorney, Agent, or Firm*—Young & Thompson

[57] ABSTRACT

The mixture is produced in the liquid state by first of all introducing in a reservoir (2) the most volatile substance in the liquid state and then circulating in a coiled tube (6) immersed in this liquid the other or each of the other substances in the liquid state before causing it to fall in the form of a spray in the reservoir. Application in the obtainment of reconstituted air.

7 Claims, 1 Drawing Figure

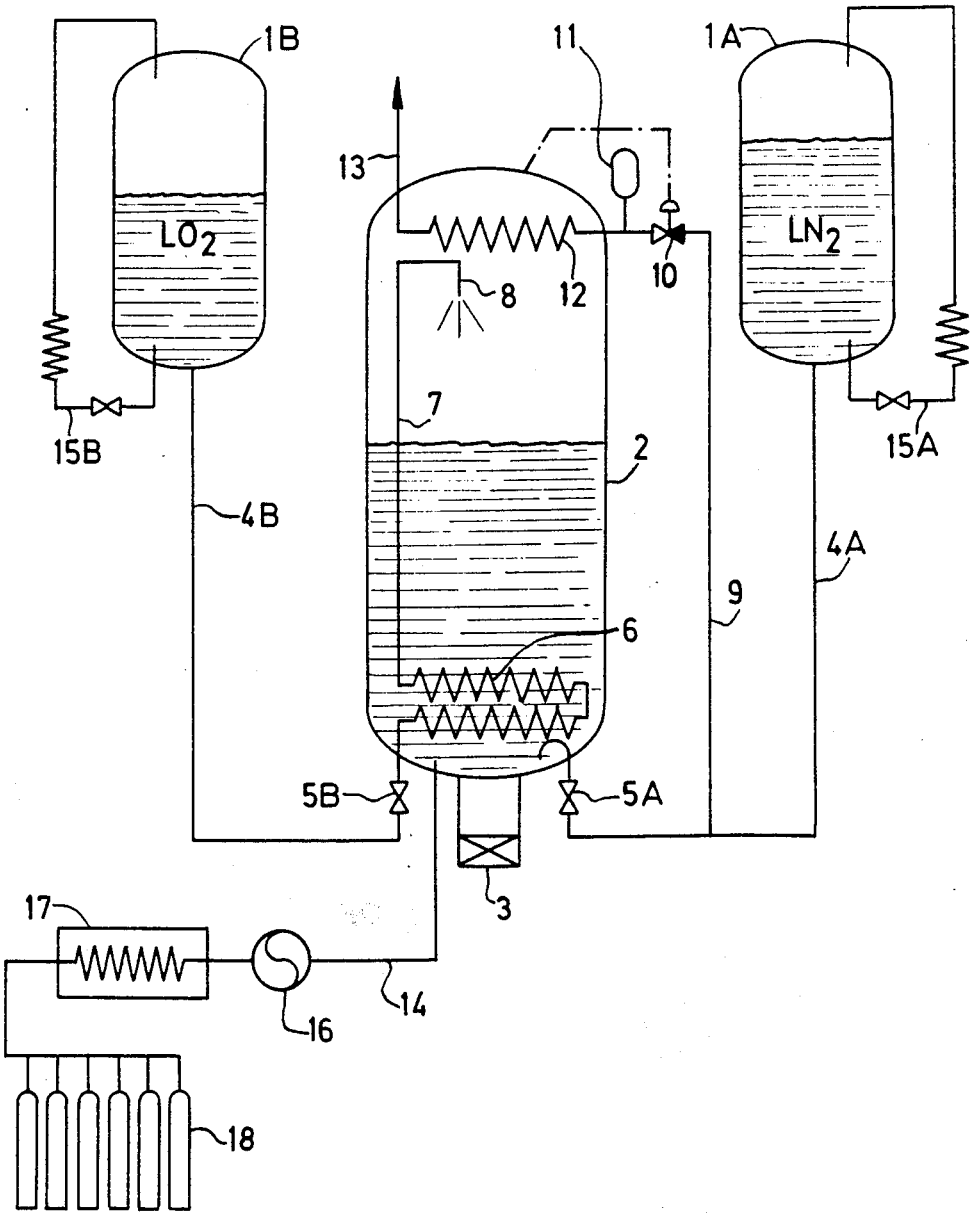
1B
11
1A
13
LO2
LN2
8
12
10
7
15B
15A
2
4B
4A
9
6
5B
5A
3
17
16
14
18

PROCESS AND APPARATUS FOR OBTAINING A MIXTURE OF SUBSTANCES HAVING LOW BOILING POINTS

The present invention relates to the production of mixtures of substances having low boiling points and different volatilities. It is in particular applicable to the production of reconstituted air from liquid oxygen and liquid nitrogen.

Reconstituted air is at present produced by evaporating on one hand liquid oxygen and on the other hand liquid nitrogen and then mixing the two gases in suitable proportions. This technique presents various technical problems, in particular when the required flow of air varies with respect to time, so as to maintain the composition of the mixture constant; it is relatively costly and requires many checking procedures.

An object of the invention is to provide a more reliable and cheaper technique for producing such mixtures. The invention therefore provides a process for delivering a mixture of given composition of substances having low boiling points and different volatilities, comprising producing the mixture in a liquid phase by sub-cooling by indirect heat exchange with the more volatile liquid the other or each of the other liquids and then mixing the liquids in a reservoir in the desired proportions.

Preferably, the whole of the most volatile liquid is first of all introduced in the reservoir and then the other or each of the other liquids is or are circulated in an indirect heat exchanger immersed in the liquid contained in the reservoir and then the mixture is effected.

The invention also provides an apparatus for producing a mixture of substances having low boiling points and different volatilities, comprising a mixture reservoir provided with means for supplying the most volatile liquid, and, on the other hand, a conduit for supplying less volatile liquid, this conduit being connected, inside the reservoir, to the inlet of an indirect heat exchanger disposed in the lower part of the reservoir, a second conduuit leading from the outlet of the exchanger and opening onto the inside of the reservoir, the latter further comprising a liquid withdrawing conduit leading from the bottom of the reservoir.

An embodiment of the invention will now be described with reference to the accompanying drawing in which the single FIGURE is a diagrammatic view of an apparatus according to the invention.

The apparatus illustrated in the drawing is adapted to produce reconstituted air and mainly comprises a container 1A for storing liquid nitrogen, a container 1B for storing liquid oxygen and a mixture reservoir 2 carried by a scale 3.

A respective conduit 4A, 4B leads from the bottom of each container 1A, 1B, is provided with an electrically-operated valve 5A, 5B and extends into the lower part of the reservoir 2. The conduit 4A terminates in this region in a freely open crook end, and the conduit 4B is connected to the inlet of a coiled heat exchange tube 6 mounted in the lower part of the reservoir. A vertical tube 7 extends from the outlet of the coiled tube 5 in the upper part of the reservoir where it is provided with a spraying system 8.

A branch pipe 9 is connected to the conduit 4A and has an electrically-operated expansion valve 10. At the outlet of the latter, the conduit 9 extends through a phase separator 11, then extends across the upper part of the reservoir 2 in forming a coiled condenser tube 12, and then issues from the reservoir through a vent 13.

The reservoir 2 is provided with a liquid withdrawing conduit 14 which extends from the bottom of the reservoir.

The apparatus of course includes the various accessories conventional in the cryogenic liquid storing technique, for example a heater 15A, 15B for raising the pressure associated with each container 1A, 1B, and suitable thermal insulation means (not shown).

The described apparatus operates in the following manner:

The liquid is drawn off at any rate of flow through the conduit 14. For example, it may be compressed by means of a pump 16, it may be passed through a vaporizer-heater 17 and the gaseous air obtained may be used for example for filling cylinders 18 under pressure, in particular for a medical utilization of this air. By way of a modification, the withdrawn liquid could also be directly transferred into a suitable cryogenic container (not shown), for example for producing a cold state.

When the level of the liquid in the reservoir 2 reaches a predetermined low level, the withdrawal of the liquid is stopped and the reservoir is completely filled. For this purpose, the valve 5A is opened. Liquid nitrogen then passes through the conduit 4A but, during a transitional stage for cooling the nitrogen, the latter is vaporized and produces an increase in the pressure of the reservoir 2. When the pressure reaches a predetermined value, the valve 10 is opened and the liquid nitrogen then passes through the conduit 9, expands in the valve 10, and flows through the coiled tube 12 in partly recondensing the vapour phase contained in the reservoir. The pressure therefore decreases and the filling with liquid nitrogen is continued.

When the required quantity of liquid nitrogen, detected by the scale 3 (or, by way of a modification, by a suitable meter), has been introduced in the reservoir, the valve 5A is closed and the valve 5B opened. Liquid oxygen is thus admitted into the coiled tube 6 and is sub-cooled therein substantially to the temperature of the liquid nitrogen. Liquid oxygen then rises in the tube 7 and falls in the form of spray from the spraying system 8 onto the liquid already contained in the reservoir. When the required quantity of liquid oxygen, detected by the scale 3 (or, by way of a modification, by a suitable meter), has been introduced, the valve 5B is closed and the withdrawal of the liquid mixture can be resumed.

The apparatus is of course provided with suitable control means for effecting the automatic operations described hereinbefore. These control means are conventional and there is no need to describe them in more detail.

The sub-cooling of the liquid oxygen with the liquid nitrogen enables the mixture to be produced under good conditions. Moreover, it produces a localized boiling on the coiled tube 6 which results in an efficient stirring of the mixture. Further, the sub-cooled liquid oxygen falling in the form of a spray dissolves a part of the nitrogen vapours produced in the course of the preceding filling stage, which contributes still further to the obtainment of a homogeneous mixture.

There is obtained in this way in the reservoir 2 a mixture of very precise composition, for example 22% liquid oxygen and 78% liquid nitrogen, the same composition of course being found in the cylinders 18. The effect of the distillation phenomenon is negligible and the composition of the mixture remains substantially constant throughout the drawing off of the mixture.

It will be understood that the invention is advantageously applicable to the obtainment of any mixture having a given composition of two or more constituents having low boiling points and volatilities distinctly different from each other.

What is claimed is:

1. A process for producing a mixture of given composition of a first fluid substance having a comparatively low cryogenic boiling point and at least one second fluid substance having a higher cryogenic boiling point, said process comprising subjecting said second substance in liquid phase to indirect heat exchange with said first substance in liquid phase, thereby sub-cooling said second substance, and then mixing said sub-cooled second substance with said first substance in proportions corresponding to said given composition.

2. A process as claimed in claim 1, in which said first and second substances when in indirect heat exchange with each other are at substantially the same pressure.

3. A process for producing a mixture of given composition of a first fluid substance having a comparatively low cryogenic boiling point and at least one second fluid substance having a higher cryogenic boiling point, said process comprising introducing a first mass of said first substance in liquid phase into a reservoir in which an indirect heat exchanger is disposed until said heat exchanger is submerged in said first mass, passing a second mass of said second substance in liquid phase in said heat exchanger thereby to sub-cool said second mass in indirect heat exchange with said first mass, and then mixing said second mass with said first mass in said reservoir, said first and second masses being selected to correspond to said given composition.

4. A process as claimed in claim 3, in which said first and second masses when in indirect heat exchange relationship with each other are at substantially the same pressure.

5. A process as claimed in claim 3, in which said mixing is effected by causing said second mass to fall above said first mass in the form of a spray.

6. A process as claimed in claim 3, and expanding another portion of said first substance to a pressure lower than the pressure in said reservoir, and placing said expanded portion in indirect heat exchange with gas from an upper portion of said reservoir thereby to cool said gas and reduce the interior pressure of the reservoir.

7. A process as claimed in claim 6, in which said expanded further portion is passed through the upper part of the reservoir.

* * * * *